US011114038B2

(12) United States Patent
Zhao et al.

(10) Patent No.: US 11,114,038 B2
(45) Date of Patent: Sep. 7, 2021

(54) DISPLAY CONTROL APPARATUS, DISPLAY CONTROL METHOD, AND DISPLAY APPARATUS

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Bin Zhao, Beijing (CN); Xi Li, Beijing (CN); Jinghua Miao, Beijing (CN); Lili Chen, Beijing (CN); Qingwen Fan, Beijing (CN); Jianwen Suo, Beijing (CN); Yukun Sun, Beijing (CN); Xuefeng Wang, Beijing (CN); Jinbao Peng, Beijing (CN); Wenyu Li, Beijing (CN); Zhifu Li, Beijing (CN); Minglei Chu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/928,362

(22) Filed: Jul. 14, 2020

(65) Prior Publication Data

US 2020/0342818 A1 Oct. 29, 2020

Related U.S. Application Data

(63) Continuation-in-part of application No. PCT/CN2019/128232, filed on Dec. 25, 2019.

(30) Foreign Application Priority Data

Jan. 2, 2019 (CN) ..... 201910001357.4

(51) Int. Cl.
*G09G 3/3275* (2016.01)

(52) U.S. Cl.
CPC ..... *G09G 3/3275* (2013.01); *G09G 2310/08* (2013.01)

(58) Field of Classification Search
CPC . G09G 3/3275; G09G 2310/08; G09G 3/3208
See application file for complete search history.

(56) References Cited

U.S. PATENT DOCUMENTS

2011/0096101 A1* 4/2011 Lee ..... G09G 3/2022 345/690
2016/0225328 A1 8/2016 Ophir et al.
(Continued)

FOREIGN PATENT DOCUMENTS

CN 101364397 A 2/2009
CN 102044227 A 5/2011
(Continued)

OTHER PUBLICATIONS

First Office Action issued in Chinese Patent Application No. 201910001357.4, dated Feb. 6, 2020; with English translation.
(Continued)

*Primary Examiner* — Christopher J Kohlman
(74) *Attorney, Agent, or Firm* — McDermott Will and Emery LLP

(57) ABSTRACT

A display apparatus includes a data driver and a light valve controller. The data driver is configured to continuously provide K display signals, all of which include a same set of image data, to a display panel. K is an integer greater than or equal to 2. The light valve controller is configured to provide a turn-off signal to a light valve whenever the data driver provides one of first T or odd-numbered display signals in the K display signals, and provide a turn-on signal to the light valve whenever the data driver provides one of
(Continued)

last (K−T) or even-numbered display signals in the K display signals. T is an integer greater than 0 and less than K, and (K−T) refers to a difference between K and T.

16 Claims, 4 Drawing Sheets

(56) References Cited

U.S. PATENT DOCUMENTS

| | | | | |
|---|---|---|---|---|
| 2017/0213503 | A1* | 7/2017 | Zhang | G02F 1/137 |
| 2018/0082626 | A1 | 3/2018 | Albrecht et al. | |
| 2019/0027107 | A1 | 1/2019 | Zhang | |
| 2020/0342818 | A1 | 10/2020 | Zhao et al. | |

FOREIGN PATENT DOCUMENTS

| | | | |
|---|---|---|---|
| CN | 102737604 | A | 10/2012 |
| CN | 107290883 | A | 10/2017 |
| CN | 107688241 | A | 2/2018 |
| CN | 109671390 | A | 4/2019 |

OTHER PUBLICATIONS

Second Office Action issued in Chinese Patent Application No. 201910001357.4, dated Aug. 18, 2020; with English translation.
International Search Report and Written Opinion issued in International Patent Application No. PCT/CN2019/128232, dated Mar. 17, 2020; with English translation.

* cited by examiner

DISPLAY CONTROL APPARATUS, DISPLAY CONTROL METHOD, AND DISPLAY APPARATUS

CROSS-REFERENCE TO RELATED APPLICATIONS

This application is a Bypass Continuation-in-Part Application of PCT/CN2019/128232 filed on Dec. 25, 2019, which claims priority to Chinese Patent Application No. 201910001357.4 filed on Jan. 2, 2019, which are incorporated herein by reference in their entirety.

TECHNICAL FIELD

The present disclosure relates to the field of display technologies, and in particular, to a display control apparatus, a display control method, a display apparatus, and a non-transitory computer-readable storage medium.

BACKGROUND

An organic light-emitting diode (OLED) display apparatus is widely used in the field of virtual reality (VR) due to its characteristics of wide color gamut, high contrast, short response time, etc. The display principle of the OLED display apparatus is to drive the light-emitting device to emit light to realize image display.

SUMMARY

In one aspect, a display control apparatus is provided. The display apparatus includes a data driver and light valve controller. The data driver configured to continuously provide K display signals, all of which include a same set of image data, to a display panel, wherein K is an integer greater than or equal to 2. The light valve controller configured to provide a turn-off signal to a light valve whenever the data driver provides one of first T or odd-numbered display signals in the K display signals, and provide a turn-on signal to the light valve whenever the data driver provides one of last (K−T) or even-numbered display signals in the K display signals, wherein T is an integer greater than 0 and less than K, and (K−T) refers to a difference between K and T.

In some embodiments, the display control apparatus further includes a timing controller and an image processor. The timing controller is electrically connected to the image processor and the data driver, the image processor is further electrically connected to the data driver. The timing controller is configured to: generate a first timing signal according to an image rendering rate, and a second timing signal according to an image refresh rate; and provide the first timing signal and the second timing signal to the image processor and the data driver, respectively. The image processor is configured to provide a plurality of sets of image data to the data driver at the image rendering rate in response to the first timing signal. The data driver is configured to provide display signals, every K display signals of which include a same set of image data, to the display panel at the image refresh rate in response to the second timing signal.

In some embodiments, the timing controller is further electrically connected to the light valve controller, and is further configured to generate a third timing signal according to the image rendering rate and the image refresh rate, and provide the third timing signal to the light valve controller, the third timing signal including turn-off signals and turn-on signals. The light valve controller is configured to: provide one of the turn-off signals to the light valve whenever the data driver provides one of the first T or odd-numbered display signals in the K display signals; and provide one of the turn-on signals to the light valve whenever the data driver provides one of the last (K−T) or even-numbered display signals in the K display signals.

In some embodiments, the timing controller is further electrically connected to the light valve controller, and is further configured to provide the first timing signal and the second timing signal to the light valve controller. The light valve controller is configured to: generate a third timing signal according to the first timing signal and the second timing signal, the third timing signal including turn-off signals and turn-on signals; provide one of the turn-off signals to the light valve whenever the data driver provides one of first T or odd-numbered display signals in the K display signals; and provide one of the turn-on signals to the light valve whenever the data driver provides one of the last (K−T) or even-numbered display signals in the K display signals.

In some embodiments, the image refresh rate is equal to 120 Hz and the image rendering rate is equal to 60 Hz.

In some embodiments, the display control apparatus further includes a timing controller and an image processor. The timing controller includes the light valve controller, and is electrically connected to the image processor, the data driver and the light valve. The image processor being further electrically connected to the data driver, wherein the timing controller is configured to: generate a first timing signal according to an image rendering rate, a second timing signal according to an image refresh rate, and a third timing signal according to the image rendering rate and the image refresh rate, the third timing signal including turn-off signals and turn-on signals; and provide the first timing signal, the second timing signal and the third timing signal to the image processor, the data driver and the light valve controller, respectively. The image processor is configured to provide a plurality of sets of image data to the data driver at the image rendering rate in response to the first timing signal. The data driver is configured to provide display signals, every K display signals of which include a same set of image data, to the display panel at the image refresh rate in response to the second timing signal.

In some embodiments, T is equal to 1.

In some embodiments, K is equal to 2.

In another aspect, a display control method is provided. The display control method includes: providing continuously, by a data driver, K display signals, all of which include a same set of image data, to a display panel, so that the display panel continuously refreshes an image K times based on the same set of image data, wherein K is an integer greater than or equal to 2; providing, by a light valve controller, a turn-off signal to a light valve whenever the data driver provides one of first T or odd-numbered display signals in the K display signals, so that the light valve blocks images displayed in first T or odd-numbered times on the display panel, wherein T is an integer greater than 0 and less than K; and providing, by the light valve controller, a turn-on signal to the light valve whenever the data driver provides one of last (K−T) or even-numbered display signals in the K display signals, wherein (K−T) refers to a difference between K and T.

In some embodiments, before providing continuously, by the data driver, K display signals, all of which include a same set of image data, to the display panel, the method further includes: generating, by a timing controller, a first timing signal according to an image rendering rate; generating, by the timing controller, a second timing signal according to an image refresh rate; providing, by the timing controller, the first timing signal to the image processor; providing, by the timing controller, the second timing signal to the data driver; and providing, by the image processor, a plurality of sets of image data to the data driver at the image rendering rate in response to the first timing signal. Providing continuously, by the data driver, K display signals, all of which include a set of image data, to the display panel K times, includes: providing, by the data driver, display signals, every K display signals of which include a same set of image data, to the display panel at the image refresh rate in response to the second timing signal.

In some embodiments, before providing, by the light valve controller, a turn-off signal to the light valve whenever the data driver provides one of first T or odd-numbered display signals in the K display signals, the method further includes: generating, by the timing controller, a third timing signal according to the image rendering rate and the image refresh rate, the third timing signal including turn-off signals and turn-on signals; and providing, by the timing controller, the third timing signal to the light valve controller. Providing, by the light valve controller, a turn-off signal to the light valve whenever the data driver provides one of the first T or odd-numbered display signals in the K display signals includes: providing, by the light valve controller, one of the turn-off signals to the light valve whenever the data driver provides one of the first T or odd-numbered display signals in the K display signals. Providing, by the light valve controller, a turn-on signal to the light valve whenever the data driver provides one of the last (K−T) or even-numbered display signals in the K display signals, includes: providing, by the light valve controller, one of the turn-on signals to the light valve whenever the data driver provides one of the last (K−T) or even-numbered display signals in the K display signals.

In some embodiments, before providing, by the light valve controller, a turn-off signal to the light valve whenever the data driver provides one of first T or odd-numbered display signals in the K display signals, the method further includes: providing, by the timing controller, the first timing signal and the second timing signal to the light valve controller generating, by the light valve controller, a third timing signal according to the first timing signal and the second timing signal, the third timing signal including turn-off signals and turn-on signals. Providing, by the light valve controller, a turn-off signal to the light valve whenever the data driver provides one of the first T or odd-numbered display signals in the K display signals, includes: providing, by the light valve controller, one of the turn-off signals to the light valve whenever the data driver provides one of the first T or odd-numbered display signals in the K display signals. Providing, by the light valve controller, a turn-on signal to the light valve whenever the data driver provides one of the last (K−T) or even-numbered display signals in the K display signals, includes: providing, by the light valve controller, one of the turn-on signals to the light valve whenever the data driver provides one of the last (K−T) or even-numbered display signals in the K display signals.

In some embodiments, the image refresh rate is equal to 120 Hz and the image rendering rate is equal to 60 Hz.

In some embodiments, T is equal to 1.

In some embodiments, K is equal to 2.

In yet another aspect, a display apparatus is provided. The display apparatus includes a display panel, a light valve, and the display control apparatus described in any of the foregoing embodiments. The light valve is disposed on the display surface of the display panel, and configured to block light emitted from the display surface of the display panel, or allow the light emitted from the display surface of the display panel to pass through. The display control apparatus is coupled to the display panel and the light valve.

In some embodiments, the light valve is a liquid crystal light valve.

In yet another aspect, a non-transitory computer-readable storage medium is provided. The non-transitory computer-readable storage medium stores computer program instructions that, when executed by a processor, cause the processor to perform one or more steps of the display control method described in any of the foregoing embodiments.

In yet another aspect, a computer program product is provided. The computer program product includes computer program instructions, which cause a computer to perform one or more steps in the display control method described in any of the foregoing embodiments when executed on the computer.

In yet another aspect, a computer program is provided. The computer program causes a computer to perform one or more steps in the display control method described in any of the foregoing embodiments when executed on the computer.

BRIEF DESCRIPTION OF THE DRAWINGS

In order to describe technical solutions in the present disclosure more clearly, accompanying drawings to be used in some embodiments of the present disclosure will be introduced briefly. Obviously, the accompanying drawings to be described below are merely accompanying drawings of some embodiments of the present disclosure, and a person of ordinary skill in the art can obtain other drawings according to these drawings.

In addition, accompanying drawings in the following description may be regarded as schematic diagrams, and are not limitations on an actual size of a product, an actual process of a method and an actual timing of signals that the embodiments of the present disclosure relate to.

DETAILED DESCRIPTION

Figure 1:
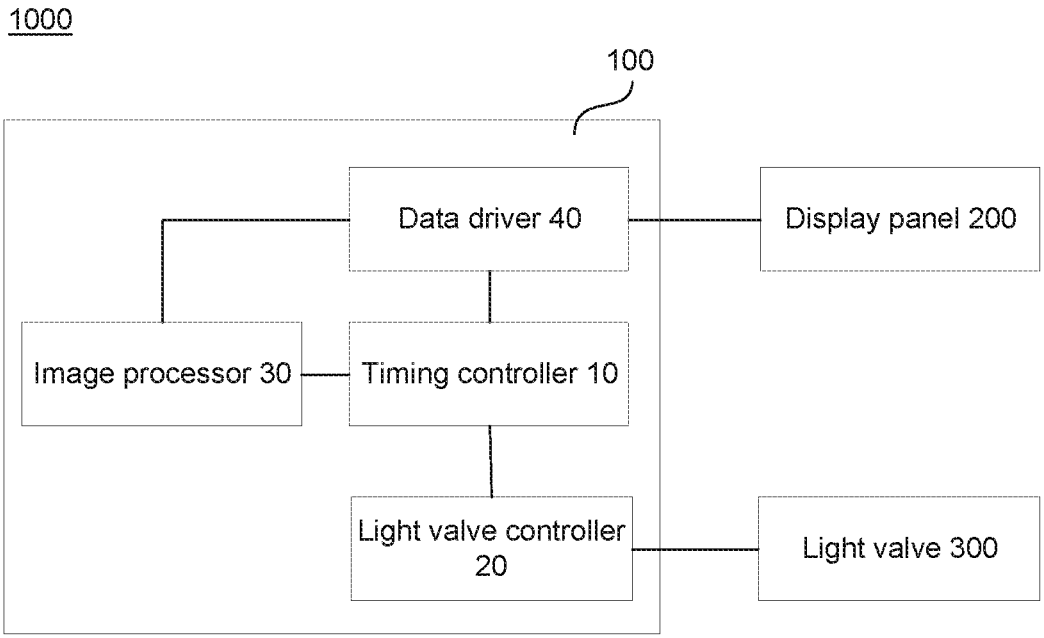
FIG. 1 is a block diagram of a display control apparatus, in accordance with some embodiments.
Figure 2:
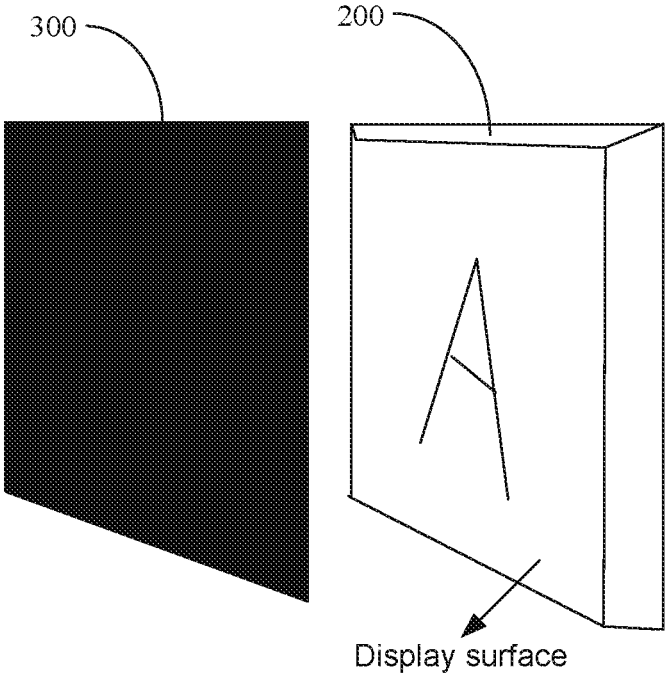
FIG. 2 is a schematic diagram of an image displayed on a display panel that is blocked by a light valve, in accordance with some embodiments.
Figure 3:
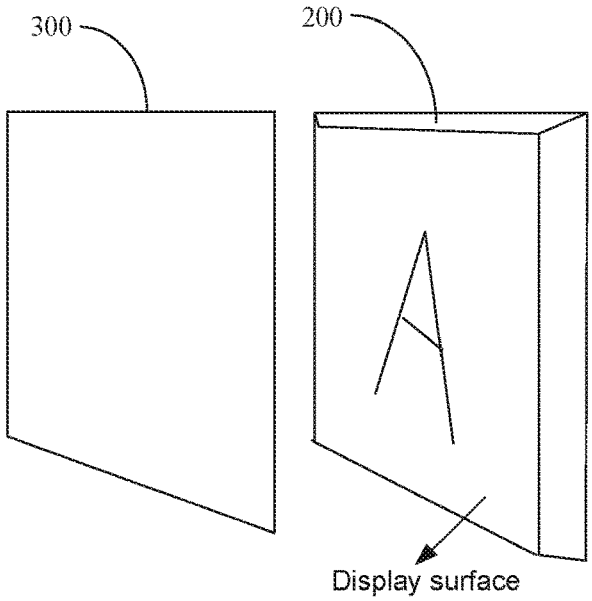
FIG. 3 is a schematic diagram of an image displayed on a display panel that is not blocked by a light valve, in accordance with some embodiments.

The technical solutions in some embodiments of the present disclosure will be described below clearly and completely with reference to accompanying drawings. Obviously, the described embodiments are merely some but not all of the embodiments of the present disclosure. All other embodiments obtained on a basis of the embodiments of the present disclosure by a person of ordinary skill in the art shall be included in the protection scope of the present disclosure.

Unless the context requires otherwise, throughout the description and claims, the term "comprise" and variation thereof, such as, the third-person singular form "comprises" and the present participle form "comprising" are construed as an open, inclusive sense, that is, "inclusive, but not limited to". The terms "first" and "second" are for descriptive purposes only and cannot be understood as indicating or implying relative importance or implicitly indicating the number of technical features. Thus, the features described with the terms "first" and "second" may explicitly or implicitly include one or more of the features. In the description of the embodiments of the present disclosure, unless otherwise stated, the meaning of "plurality" is two or more.

In the description, terms such as "one embodiment", "some embodiments", "exemplary embodiments", "example", "specific example" or "some examples" are intended to indicate that specific features, structures, materials or characteristics related to the embodiments or examples are included in at least one embodiment or example of the present disclosure. Schematic representations of the above terms do not necessarily refer to the same embodiments or examples. In addition, the specific features, structures, materials or characteristics may be included in any one or more embodiments or examples in any suitable manner.

Some embodiments may be described using terms "coupled" and "connected" along with their derivatives. For example, some embodiments may be described using the term "connected" to indicate that two or more components are in direct physical or electrical contact with each other. For another example, some embodiments may be described using the term "coupled" to indicate that two or more components are in direct physical or electrical contact with each other. However, the term such as "connected" or "coupled" may also mean that two or more components are not in direct contact with each other, but yet still co-operate or interact with each other. The embodiments disclosed herein are not necessarily limited to this content.

In the process of an organic light-emitting diode (OLED) display apparatus displaying dynamic images, when a difference between the gray scales of two adjacent frames is large, for example, when a dark frame changes into a bright frame, due to the influence of the display driving circuit and/or the material properties of the light-emitting device, the brightness of the light emitted by the light-emitting device of a pixel cannot meet a requirement of a target gray scale. For example, the brightness can only reach about 70% of the target gray scale, which may cause the dynamic images displayed on the OLED display apparatus to become smeared.

In a case where the OLED display apparatus is applied in the field of virtual reality (VR), the images displayed on the OLED display apparatus are changing dynamically. For example, the gray scales of pixels of two adjacent frames in a same position are constantly switching between high and low gray scales, which may cause the smear phenomenon to be particularly serious.

In the related art, when the OLED display apparatus display the dynamic images, the driving voltage (current) of the light-emitting device is generally increased to make the brightness of the light emitted by the light-emitting device reach the target gray scale, so as to solve the problem of smear. However, in order to determine the relationship between the added value of the driving voltage (current) and the variation value of the gray scale, a large number of tests on image data are needed in the above method before the OLED display apparatus leaves the factory. Then, the driving voltage is controlled according to the relationship between the added value of the driving voltage (current) and the variation value of the gray scale when the display apparatus displays images, which may increase the workload and reduce the production efficiency.

Herein, it is assumed that in the process of the OLED display apparatus displaying dynamic images, situations of three adjacent frames are as follows: the first frame is darker, the second frame and the third frame are brighter and their luminance is the same.

In a case where the image refresh rate $\eta$ of the display panel of the OLED display apparatus is equal to the image rendering rate $\gamma$ of the display panel, that is, every time the display panel refreshes the image, it displays one frame. In this way, the first frame, the second frame and the third frame are in three different image rendering periods.

The image refresh rate $\eta$ refers to a rate at which an image is refreshed on the display panel, i.e., the number of times the image displayed on the display panel is refreshed per second. The image rendering rate $\gamma$ indicates a speed at which an image is rendered, that is, the number of times a three-dimensional image is converted into a two-dimensional image per second, which may be regarded as the speed at which the image changes.

On this basis, when the OLED display apparatus enters a next image rendering period from one image rendering period, that is, when the image displayed thereon changes from the first frame to the second frame, the brightness of the light emitted by the light-emitting devices of the pixels cannot meet the requirements of the target gray scales of the second frame. When the OLED display apparatus enters an image rendering period after the next image rendering period, that is, in the third frame (the brightness of the third frame is consistent with the brightness of the second frame, and the target gray scales requirement for the pixels of the third frame is the same as the target gray scales requirements for the pixels of the second frame), the brightness of the light emitted by the light-emitting devices of the pixels can meet the requirement of the target gray scales. That is to say, when the OLED display apparatus is about to display certain target gray scales, the gray scales of the first frame cannot reach the target gray scales, and the gray scales of the next frame can reach the target gray scales.

In some embodiments of the present disclosure, as shown in FIG. 1, a display apparatus 1000 includes a display control apparatus 100, and the display control apparatus 100 is configured to control the display apparatus 1000 to display images. The display apparatus 1000 further includes a display panel 200 and a light valve 300 disposed on a display surface of the display panel 200. The display apparatus 1000 is, for example, a portable display apparatus such as a VR display apparatus, or may be a non-portable display apparatus such as a desktop computer.

As shown in FIG. 1, the display control apparatus 100 includes a data driver 40 and a light valve controller 20. The data driver 40 is electrically connected to the display panel 200. The light valve controller 20 is electrically connected to the light valve 300. The light valve controller 20 may be a simple control circuit or a control chip.

The data driver 40 is configured to continuously provide K display signals, all of which include a same set of image data, to the display panel 200. K is an integer greater than or equal to 2. For example, K is equal to 2, 3, 4, or 5.

The frame displayed on the display panel 200 is based on the set of image data, which is corresponds to the pixels of the display panel 200, and the data in the set of image data may be used to drive the light-emitting device of the corresponding pixel to emit light with a corresponding brightness level, so as to make the pixel reach the target gray scale. For example, the set of image data may be the driving voltage or driving current of the pixels of the display panel 200. That K display signals including a same set of image data are provided to the display panel 200, means that K frames based on a same set of image data may be displayed on the display panel 200. That is to say, the K display signals may include the same driving voltage or same driving current for pixels in the same position, and are intended to present the same picture. It will be noted that, different sets of image data may correspond to different images that may present different pictures. That is, an image corresponds to a set of image data. The set of image data includes data required for the display panel 200 to display a frame.

The light valve controller 20 is configured to provide a turn-off signal to the light valve 300 whenever the data driver 40 provides one of the first T or odd-numbered display signals in the K display signals, and provide a turn-on signal to the light valve 300 whenever the data driver 40 provides one of last (K−T) or even-numbered display signals in the K display signals. T is an integer greater than 0 and less than K. For example, K is equal to 2, and T is equal to 1. For another example, K is equal to 3, and T is equal to 1 and 3.

For example, K is equal to 3, and T is equal to 1. That is, the data driver 40 continuously provides three display signals including a same set of image data to the display panel 200, so that the display panel 200 continuously refreshes an image three times based on the same set of image data. In addition, the light valve controller 20 provides a turn-off signal to the light valve 300 whenever the data driver 40 provides the first display signal in the three display signals, so that the image displayed for the first time on the display panel 200 is blocked by the light valve 300.

Alternatively, K is equal to 3, and T is equal to 2. That is, the data driver 40 continuously provides three display signals including a same set of image data to the display panel 200, so that the display panel 200 continuously refreshes the image three times based on the same set of image data. In addition, the light valve controller 20 provides a turn-off signal to the light valve 300 whenever the data driver 40 provides one of the first two display signals, so that the images displayed in first two times on the display panel 200 are blocked by the light valve 300.

In the display control apparatus 100, the data driver 40 continuously provides K display signals (K≥2) based on the same set of image data, that is, the display panel 200 displays at least two frames according to the same set of image data. Further, by controlling the light valve 300 to block images displayed in first T times or odd-numbered times on the display panel 200, the first T frames or odd-numbered frames of the K frames displayed on the display panel 200 can be blocked. In this way, the first frame of the K frames displayed on the display panel 200 can be blocked and will not be displayed on the display apparatus 1000, which may improve the smear of the frames. In addition, the images displayed in last (K−T) or even-numbered times on the display panel 200 are not blocked, that is, among the K frames displayed on the display panel 200, the last (K−T) or even-numbered frames are not blocked and can be displayed on the display apparatus 1000. Since the last (K−T) or even-numbered frames can reach the target gray scales, the images viewed by the user may not become smeared, thereby improving the smear of the frames.

In addition, compared with the related art, the display control apparatus 100 provided by some embodiments of the present disclosure does not need to increase the driving voltage (current) to alleviate the problem of smear of the images. Therefore, there is no need to determine the relationship between the added value of the driving voltage (current) and the variation value of the gray scale according to results of the tests on image data before the display apparatus leaves the factory, thereby reducing the number of tests on image data before the display apparatus leaves the factory and improving production efficiency.

In some embodiments, as shown in FIG. 1, the display control apparatus 100 further includes a timing controller 10 and an image processor 30. The timing controller 10 is electrically connected to the image processor 30, the data driver 40 and the light valve controller 20, and the image processor 30 is electrically connected to the data driver 40.

For example, the image processor 30 may be a central processing unit (CPU), other general-purpose processors, a digital signal processor (DSP), an application specific integrated circuits (ASIC), a field programmable gate array (FPGA), or other programmable logic devices, a discrete gate or transistor logic devices, a discrete hardware component, etc.

The timing controller 10 is configured to: generate a first timing signal according to an image rendering rate $\gamma$, and a second timing signal according to an image refresh rate $\eta$; and provide the first timing signal and the second timing signal to the image processor 30 and the data driver 40, respectively.

As described above, the image rendering rate $\gamma$ refers to the number of times a two-dimensional image, i.e., a frame, is generated per second, and the image refresh rate $\eta$ refers to the number of times the frame displayed on the display panel is refreshed per second. The image rendering rate $\gamma$ and the image refresh rate $\eta$ may be set before the display apparatus 1000 leaves the factory. For example, the image rendering rate $\gamma$ and the image refresh rate $\eta$ are received from input through, for example, a mouse, touchpad, keyboard, any other suitable input device, or any combination thereof before the display apparatus 1000 leaves the factory. Of course, the image rendering rate $\gamma$ and the image refresh rate $\eta$ may also be set by the users through, for example, a mouse, touchpad, keyboard, any other suitable input device, or any combination thereof.

Figure 4A:
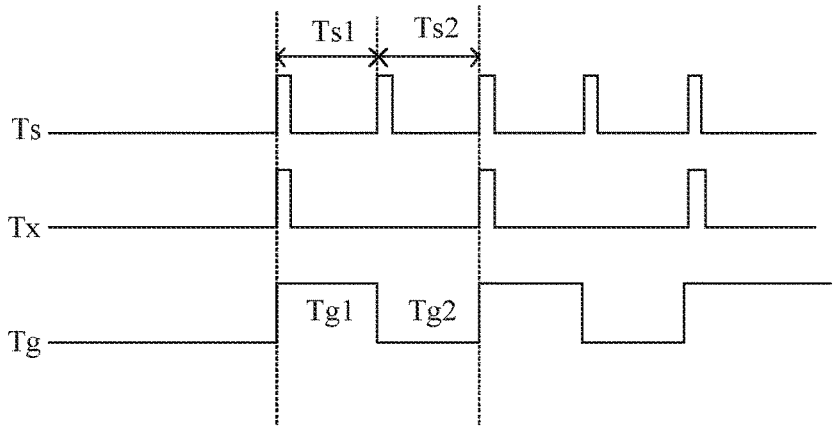
FIG. 4A is a timing diagram of controlling a display apparatus, in accordance with some embodiments.

As shown in FIG. 4A, both the first timing signal and the second timing signal include pulses. The number of pulses per second of the first timing signal may be equal to the image rendering rate, and the number of pulses per second of the second timing signal may be equal to the image refresh rate.

The image processor 30 is configured to provide a plurality of sets of image data to the data driver 40 at the image rendering rate $\gamma$ in response to the first timing signal.

The plurality of sets of image data may be cached in a memory, and in response to receiving the first timing signal, the image processor 30 retrieves and provides the plurality of sets of image data to the data driver 40. The memory may be a CPU cache, or other storage media.

The data driver 40 is configured to provide display signals, every K display signals of which include a same set of image data, to the display panel 200 at the image refresh rate $\eta$ in response to the second timing signal.

It will be understood since the data driver 40 provides display signals at the image refresh rate η, the image processor 30 provides the plurality of sets of image data to the data driver 40 at the image rendering rate γ, and the data driver 40 continuously provides K display signals including the same set of image data to the display panel 200, the relationship between the image refresh rate η and the image rendering rate γ is that the image refresh rate η is equal to K times the image rendering rate γ, that is, η is equal to a product of K and γ.

In this way, the display panel 200 continuously refreshes the image K times based on the same set of image data, which means that the display panel 200 displays K frames based on the same set of image data, thereby improving the display effect of the image.

In addition, the image refresh rate η is increased to be greater than the image rendering rate γ, so that the display panel 200 continuously refreshes a same image K times. In a case where the image refresh rate is high, although the users cannot see the images refreshed in the first T times, the display effect of the display panel may not be effected.

In some embodiments, the timing controller 10 is further configured to provide the first timing signal and the second timing signal to the light valve controller 20. The light valve controller 20 is configured to: generate a third timing signal according to the first timing signal and the second timing signal, the third timing signal including turn-off signals and turn-on signals; provide one of the turn-off signals to the light valve 300 whenever the data driver 40 provides one of the first T or odd-numbered display signals in the K display signals; and provide one of the turn-on signals to the light valve 300 whenever the data driver 40 provides one of the last (K−T) or even-numbered display signals in the K display signals.

For example, the timing controller 10 includes agate circuit, and the gate circuit generates the third timing signal according to the first timing signal and the second timing signal.

In some examples, as shown in FIG. 4A, the third timing signal (referring to Tg) includes turn-off signals and turn-on signals. For example, the turn-off signal is a high level signal, and the turn-on signal is a low level signal.

For example, the light valve 300 is a liquid crystal light valve. The liquid crystal light valve may include a first substrate, a second substrate, and a liquid crystal layer between the first substrate and the second substrate. When the high level signal is provided to the liquid crystal light valve, the liquid crystal molecules are deflected, so that the liquid crystal light valve does not allow light to pass through. When the low level signal is provided to the liquid crystal light valve, the liquid crystal molecules are not reflected, so that the liquid crystal light valve allows light to pass through.

Figure 4B:
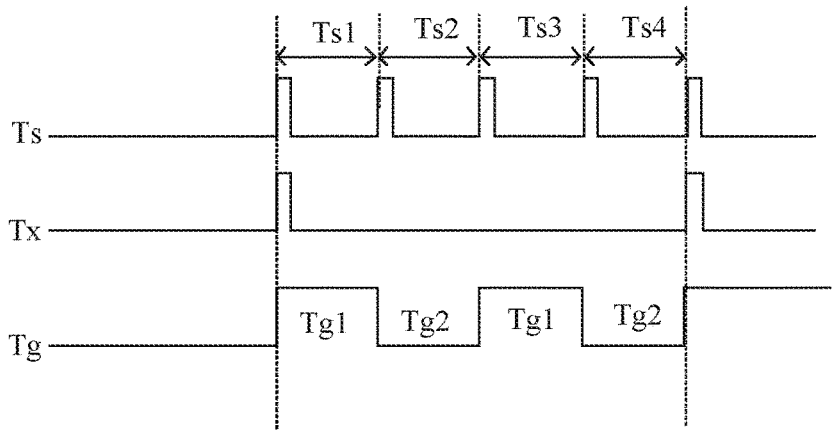
FIG. 4B is another timing diagram of controlling a display apparatus, in accordance with some embodiments.

To facilitate the description of the relationship among the first timing signal, the second timing signal and the third timing signal, as shown in FIGS. 4A and 4B, an image rendering period Tx, a light valve control period Tg including both a light valve turn-off period Tg1 and a light valve turn-on period Tg2, and image refresh periods Ts including both a first image refresh period Ts and a second image refresh period Ts2 are introduced. The image rendering period Tx corresponds to a time for the display panel 200 to display images according to a same set of image data. The image refresh period Ts corresponds to a time for the display panel 200 to display each image of images based on a same set of image data.

In some embodiments, the light valve turn-off period Tg1 corresponds to a time for the display panel 200 to display images in first T times in the image rendering period Tx, and the light valve turn-on period Tg2 corresponds to a time for the display panel 200 to display images in last (K−T) times in the image rendering period Tx. That is to say, the duration of each light valve control period Tg is equal to the duration of each image rendering period Tx, and they are a same period. The duration of the light valve turn-off period Tg1 of each light valve control period Tg is equal to the time required for the display panel 200 to display the images in the first T times. That is, the duration of the light valve turn-off period Tg1 is equal to the duration of the display period of the first frame to the T-th frame in the image rendering period Tx. The duration of the light valve turn-on period Tg2 of each light valve control period Tg is equal to the time required for the display panel 200 to display the images in the last (T−K) times. That is, the duration of the light valve turn-on period Tg2 is equal to the duration of the display period of the (T+1)-th frame to the K-th frame in the image rendering period Tx.

In a case where the duration of each light valve control period Tg is equal to the duration of each image rendering period Tx. For example, in a case where the light valve control period Tg and the image rendering period Tx are the same period, K is equal to 2, and T is equal to 1, a timing diagram of controlling a display apparatus is shown in FIG. 4A. Referring to FIG. 4A, one image rendering period Tx corresponds to two image refresh periods Ts (i.e., the first image refresh period Ts1 and the second image refresh period Ts2), and the display panel 200 displays the first frame in the first image refresh period Ts1, and the second frame in the second image refresh period Ts2. In addition, in the image rendering period Tx, the light valve controller 20 provides a high level signal to the light valve 300 during the light valve turn-off period Tg1, so that the light valve 300 is turned off to block the image (i.e., the first frame) displayed on the display panel 200 in the first image refresh period Ts1; and the light valve controller 20 provides a low level signal to the light valve 300 during the light valve turn-on period Tg2, so that the light valve 300 is turned on to stop blocking the image (i.e., the second frame) displayed on the display panel 200 in the second image refresh period Ts2.

Based on the above embodiments, the light valve 300 may be used to block the images displayed in first T times on the display panel 200 in each image rendering period Tx, and not to block the images displayed in last (K−T) times on the display panel 200 in each image rendering period Tx.

In some other embodiments, the light valve turn-off period Tg1 corresponds to a time for the display panel 200 to display images in the odd-numbered times in the image rendering period Tx, and the light valve turn-on period Tg2 corresponds to a time for the display panel 200 to display images in even-numbered times in the image rendering period Tx. It means that, the duration of each light valve control period Tg is equal to the duration of each image rendering period Tx, and they are a same period. The duration of each light valve turn-off period Tg1 in each light valve control period Tg is equal to the time for the display panel 200 to display an odd-numbered frame, and the duration of the light valve turn-on period Tg2 in each light valve control period Tg is equal to the time for the display panel 200 to display an even-numbered frame. It will be noted that, the odd-numbered frame is the image displayed by the display panel 200 in odd-numbered time, such as the image displayed in the first time, the third time, the fifth time, etc. The even-numbered frame is the image displayed on the display panel 200 in even-numbered time, such as the second time, the fourth time, the sixth time, etc.

For example, in a case where the light valve control period Tg and the image rendering period Tx are a same period, and K is an even number, such as 4, a timing diagram of controlling a display apparatus is shown in FIG. 4B. Referring to FIG. 4B, K is equal to 4, one image rendering period Tx corresponds to four image refresh periods Ts (i.e., a first image refresh period Ts1, a second image refresh period Ts2, a third image refresh period Ts3, and a fourth image refresh period Ts4), and the display panel 200 displays, in each image refresh period, a corresponding frame. When the display panel 200 is in the first image refresh period Ts1 and the third image refresh period Ts3, the light valve controller 20 is in the light valve turn-off period Tg1, and provides a high level signal to the light valve 300, so that the light valve 300 is turned off to block the images (i.e., the first frame and the third frame) displayed on the display panel 200 in the first image refresh period Ts1 and the third image refresh period Ts3. When the display panel 200 is in the second image refresh period Ts2 and the fourth image refresh period Ts4, the light valve controller 20 is in the light valve turn-on period Tg2, and provides a low level signal to the light valve 300, so that the light valve 300 is turned on to stop blocking the images (i.e., the second frame and the fourth frame) displayed on the display panel 200 in the second image refresh period Ts2 and the fourth image refresh period Ts4. In this way, in each image rendering period Tx, the light valve 300 may block the odd-numbered frames (i.e., the first frame and the third frame) displayed on the display panel 200, and may not block the even-numbered frames (i.e., the second frame and the fourth frame) displayed on the display panel 200.

Figure 4C:
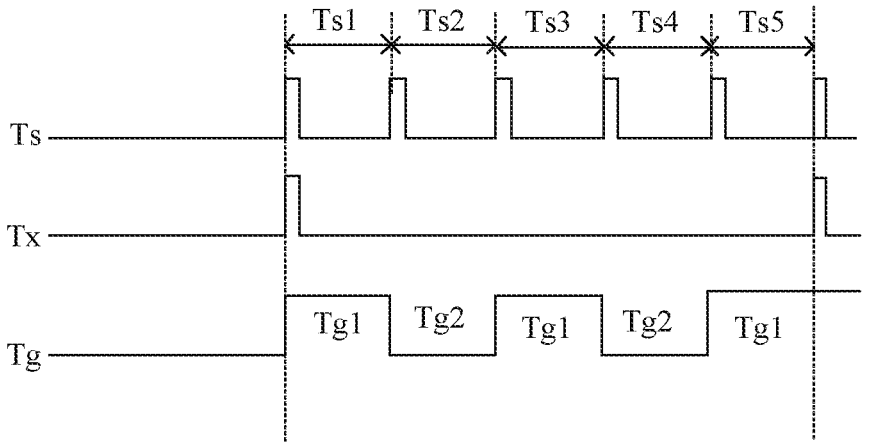
FIG. 4C is yet another timing diagram of controlling a display apparatus, in accordance with some embodiments.

For example, in a case where the light valve control period Tg and the image rendering period Tx are a same period, and K is an odd number, such as 5, a timing diagram of controlling a display apparatus is shown in FIG. 4C. Referring to FIG. 4C, K is equal to 5, one image rendering period Tx corresponds to five image refresh periods Ts (i.e., a first image refresh period Ts1, a second image refresh period Ts2, a third image refresh period Ts3, a fourth image refresh period Ts4, and a fifth image refresh period Ts5), and the display panel 200 displays, in each image refresh period, a corresponding frame. When the display panel 200 is in the first image refresh period Ts1, the third image refresh period Ts3 and the fifth image refresh period Ts, the light valve controller 20 is in the light valve turn-off period Tg1, and provides a high level signal to the light valve 300, so that the light valve 300 is turned off to block images (i.e., the first frame, the third frame and the fifth frame) displayed on the display panel 200 in the first image refresh period Ts1, the third image refresh period Ts3 and the fifth image refresh period Ts5. When the display panel 200 is in the second image refresh period Ts2 and the fourth image refresh period Ts4, the light valve controller 20 is in the light valve turn-on period Tg2, and provides a low level signal to the light valve 300, so that the light valve 300 is turned on to stop blocking the images (i.e., the second frame and the fourth frame) displayed on the display panel 200 in the second image refresh period Ts2 and the fourth image refresh period Ts4. In this way, in each image rendering period Tx, the light valve 300 may block the odd-numbered frames (i.e., the first frame, the third frame and the fifth frame) displayed on the display panel 200, and may not block the even-numbered frames (i.e., the second frame and the fourth frame) displayed on the display panel 200.

Based on the above embodiments, the light valve 300 may be used to block the images displayed in odd-numbered times (i.e. the odd-numbered frames) on the display panel 200 in each image rendering period Tx, and not to block the images displayed in even-numbered times (i.e. the even-numbered frames) on the display panel 200 in each image rendering period Tx.

In some embodiments, the timing controller 10 is further configured to generate a third timing signal according to the image rendering rate and the image refresh rate, and provide the third timing signal to the light valve controller 20. The third timing signal includes turn-off signals and turn-on signals. The light valve controller 20 is configured to: provide one of the turn-off signals to the light valve 300 whenever the data driver 40 provides one of the first T or odd-numbered display signals in the K display signals; and provide one of the turn-on signals to the light valve 300 when the data driver 40 provides one of the last (K−T) or even-numbered display signals in the K display signals.

For example, as shown in FIG. 4A, the number of pulses per second of the third timing signal is equal to the image rendering rate, and is equal to a quotient of the image refresh rate and K.

In the above embodiments, the timing controller 10 generates the first timing signal, the second timing signal and the third timing signal, which may enhance the synchronization of the first to third timing signals, so that the light valve controller 20 may control the light valve 300 more accurately to block the images displayed in the first T times on the display panel 200.

Figure 5:
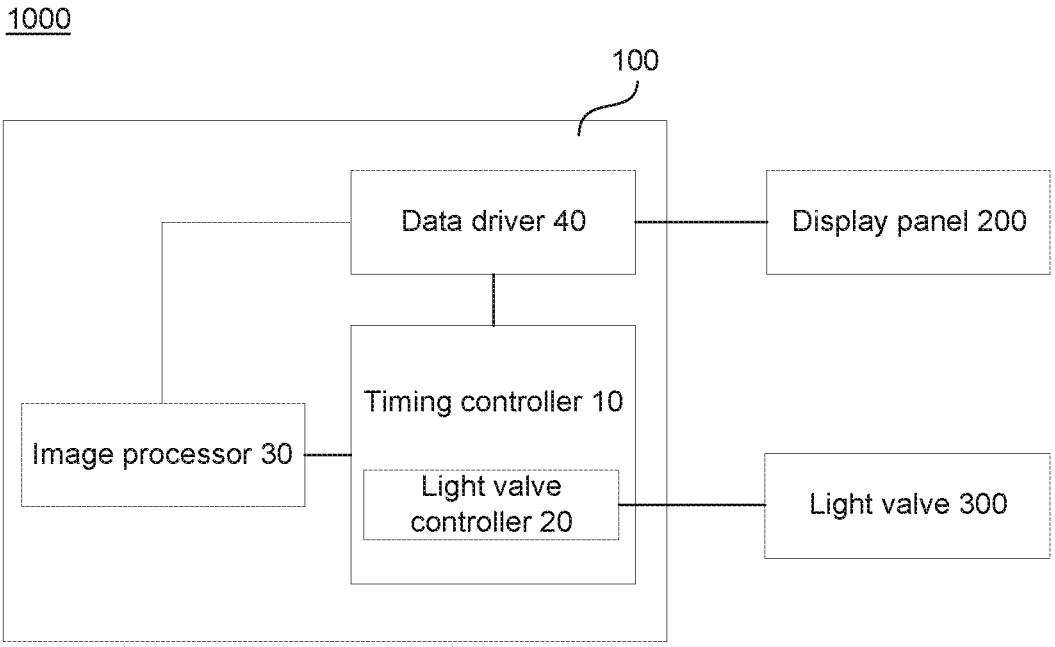
FIG. 5 is another block diagram of a display control apparatus, in accordance with some embodiments.

In some embodiments, as shown in FIG. 5, as a module of the timing controller 10, the light valve controller 20 is integrated in the timing controller 10. In this case, the timing controller 10 is configured to generate the third timing signal according to the image rendering rate and the image refresh rate, and provide the third timing signal to the light valve 300.

In some embodiments, T is equal to 1. That is, in each image rendering period Tx, no matter how many times the display panel 200 refreshes an image continuously under the control of the data driver 40, the light valve 300 only block the image displayed for the first time on the display panel 200 under the control of the light valve controller 20.

For example, in each image rendering period Tx, the display panel 200 continuously refreshes an image twice, and the light valve 300 only block the image displayed for the first time on the display panel 200 under the control of the light valve controller 20. For another example, in each image rendering period Tx, the display panel 200 continuously refreshes an image three times, and the light valve 300 only block the image displayed for the first time on the display panel 200 under the control of the light valve controller 20.

When the display panel 200 enters the next image rendering period from one image rendering period, the image displayed for the first time on the display panel 200 cannot reach the requirement for the target gray scales, and the image displayed for the second time can reach the requirement for target gray scales. On this basis, T is set to be 1, so that the light valve controller 20 controls the light valve 300 to block the image displayed for the first time on the display panel 200 in each image rendering period Tx. In this way, the time, during which the image displayed on the display panel 200 is blocked by the light valve 300, in each image rendering period Tx may be shorten, the time, during which the images displayed on the display panel 200 are not blocked by the light valve 200 and can be viewed by the users, may be increased. As such, the time of the display panel going black may be reduced, and the flickering phenomenon caused by the image displayed on the display panel being blocked may be reduced, thus improving the display effect of the display panel 200.

In some embodiments, as shown in FIGS. 1 to 4A, K is equal to 2. It means that, the data driver 40 continuously provides two display signals including a same set of image data to the display panel 200, so that the display panel 200 refreshes an image twice in each image rendering period Tx.

In this case, the data driver 40 transmits the same set of image data to the display panel 200 twice in one image rendering period Tx, so that the display panel 200 continuously refreshes an image twice in each image rendering period Tx, and the two refreshed images are based on the same set of image data. That is, the display panel 200 displays two frames based on the same set of image data. The image displayed for the first time on the display panel 200 in an image rendering period Tx is defined as an odd-numbered frame, and the image displayed for the second time on the display panel 200 in the image rendering period Tx is defined as an even-numbered frame.

In some examples, the image refresh rate η is equal to 120 Hz, and the image rendering rate γ is equal to 60 Hz. It means that, the image processor 30 provides a plurality of sets of image data at an image rendering rate of 60 Hz, i.e., generates the sets of image data for 60 images per second. The data driver 40 sends display signals to the display panel 200 at an image refresh rate of 120 Hz. That is, The data driver 40 sends display signals to the display panel 200 120 times per second, and every two times are based on a same set of image data, so that every two frames displayed on the display panel 200 are based on a same set of image data.

In the related art, the image refresh rate η of the display panel is equal to the image rendering rate γ thereof, and they are both 60 Hz. In the embodiments of the present disclosure, the image refresh rate η is set to 120 Hz and the image rendering rate γ is set to 60 Hz. That is, the image rendering rate γ is the same as the original image rendering rate γ, and the image refresh rate η is multiplied to be twice the image rendering rate γ, so that the display panel 200 continuously refreshes the image twice in each image rendering period Tx. Therefore, by doubling the image refresh rate η and causing the light valve controller 20 to control the light valve 300 to dynamically block the odd-numbered frame, the images displayed on the display panel 200 viewed by the users will not become smeared without increasing the burden of image rendering.

In addition, when the image refresh rate η is equal to 120 Hz, the image refresh rate η is high. In this case, although the users cannot see the odd-numbered frame refreshed in each image rendering period Tx, the display effect of the display apparatus may not be affected.

In order to more clearly explain the control process of the display control apparatus 100 provided by the embodiments of the present disclosure, a detailed description will be given below by taking η being equal to 120 Hz, γ being equal to 60 Hz, T being equal to 1, and K being equal to 2 as an example.

As shown in FIGS. 1 to 4A, the image processor 30 provides a plurality of sets of image data at the image rendering rate γ to the data driver 40. The data driver 40 sends display signals, every K display signals of which include a same set of image data, to the display panel 200 at the image refresh rate η. In one image rendering period Tx, the data driver 40 continuously sends two display signals including a same set of image data to the display panel 200, so that the display panel 200 continuously refreshes the image twice. The two images are based on the same set of image data. That is, in one image rendering period Tx, the timing controller 10 controls the display panel 200 to be in two consecutive image refresh periods Ts, and the two image refresh periods Ts include a first image refresh period Ts1 and a second image refresh period Ts2. In a case where the display panel 200 is in the first image refresh period Ts1, the light valve controller 20 sends a turn-off signal to the light valve 300 to control the light valve 300 to be in a turn-off state. In a case where the display panel 200 is in the second image refresh period Ts2, the light valve controller 20 sends a turn-on signal to control the light valve 300 to be in a turn-on state. The turn-off state means that the light valve 300 does not allow light to pass through, and the turn-on state means that the light valve 300 allows the light to pass through.

In each image rendering period Tx, when the display panel 200 is in the first image refresh period Ts1, the display panel 200 displays the odd-numbered frame, and the light valve controller 20 controls the light valve 300 to be in the light valve turn-off period Tg1, so as to control the light valve 300 to block the odd-numbered frame displayed on the display panel 200. When the display panel 200 is in the second image refresh period Ts2, the display panel 200 displays the even-numbered frame, and the light valve controller 20 controls the light valve 300 to be in the light valve turn-on period Tg2 to control the light valve 300 not to block the even-numbered frame displayed on the display panel 200, so that the image can be viewed by the users.

Figure 6:
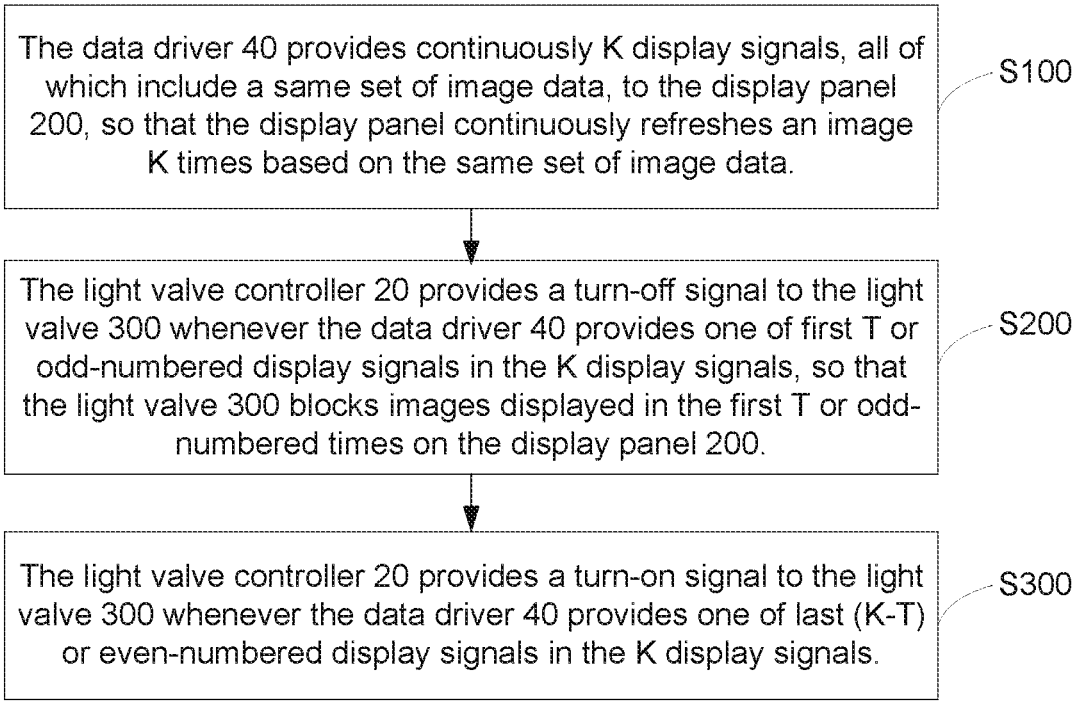
FIG. 6 is a flow diagram of a display control method, in accordance with some embodiments.

As shown in FIGS. 1, 4A and 6, some embodiments of the present disclosure provide a display control method. The display control method includes S100 to S300.

In S100, the data driver 40 provides continuously K display signals, all of which include a same set of image data, to the display panel 200, so that the display panel continuously refreshes an image K times based on the same set of image data. K is an integer greater than or equal to 2.

In S200, the light valve controller 20 provides a turn-off signal to the light valve 300 whenever the data driver 40 provides one of the first T or odd-numbered display signals in the K display signals, so that the light valve 300 blocks images displayed in the first T or odd-numbered times on the display panel 200. T is an integer greater than 0 and less than K.

In S300, the light valve controller 20 provides a turn-on signal to the light valve 300 whenever the data driver 40 provides one of the last (K−T) or even-numbered display signals in the K display signals. (K−T) refers to a difference between K and T.

For example, as shown in FIGS. 2 to 4A, in a case where η is equal to 120 Hz, γ is equal to 60 Hz, and K is equal to 2, the data driver 40 may provide continuously two display signals including a same set of image data to the display panel 200, so that the display panel 200 may refresh the image twice in one image rendering period Tx. That is, in one image rendering period Tx, the display panel 200 has two image refresh periods Ts.

For example, K is equal to 3, and T is equal to 1. That is, the display panel 200 continuously refreshes the image three times in the image rendering period Tx, and the image displayed for the first time on the display panel 200 is blocked by the light valve 300. Alternatively, K is equal to 3, and T is equal to 2. That is, the display panel 200 continuously refreshes the image three times in the image rendering period Tx, and the images displayed in first two times on the display panel 200 are blocked by the light valve 300.

In some embodiments, before S100, the method further includes S400 and S500.

In S400, the timing controller 10 generates a first timing signal according to an image rendering rate γ, and a second timing signal according to an image refresh rate r; and provides the first timing signal to the image processor 30, and the second timing signal to the data driver 40.

In S500, the image processor 30 provides a plurality of sets of image data to the data driver 40 at the image rendering rate γ in response to the first timing signal.

In this case, S100 includes: providing, by the data driver 40, display signals, every K display signals of which include a same set of image data, to the display panel 200 at the image refresh rate η in response to the second timing signal.

In the above display control method, the display panel 200 displays images at least two times based on the same set of image data in the image rendering period Tx. That is to say, the display panel 200 displays at least two images in one image rendering period Tx, and in each image rendering period Tx, the light valve controller 20 controls the light valve 300 to block the images displayed in the first T or odd-numbered times on the display panel 200. That is, in the K images displayed on the display panel 200, the first T images or the odd-numbered images are blocked.

In this way, in each image rendering period Tx, one image is continuously refreshed K times, and the display panel 200 displays K images based on the same set of image data. The images refreshed in the first T or odd-numbered times are blocked by the light valve 300, and the images refreshed in the remaining (K−T) times or in the even-numbered times are not blocked, and can be viewed by the users. When the display apparatus 100 enters the next image rendering period Tx from one image rendering period Tx and is about to display a certain target gray scale, the first frame may not reach the target gray scales, and the next frame may reach the target gray scales. In each image rendering period Tx, the first T frames or the odd-numbered frames displayed on the display panel 200 which may not reach the target gray scales are blocked by the light valve 300, and will not be viewed by the users, and the last (T+1)-th to K-th frames or the even-numbered frames displayed on the display panel 200 which may reach the target gray scales can be viewed by the users. Therefore, the display effect of the display apparatus may be improved.

In the embodiments, before the S200, the method further includes S600 and S700.

In S600, the timing controller 10 generates a third timing signal according to the image rendering rate and the image refresh rate, the third timing signal including turn-off signals in light valve turn-off periods Tg1 and turn-on signals in light valve turn-on periods Tg2.

In S700, the timing controller 10 provides the third timing signal to the light valve controller 20.

The S600 and S700 may be performed during the S400.

In this case, the S200 includes: providing, by the light valve controller 20, one of the turn-off signals to the light valve 300 whenever the data driver 40 provides one of the first T or odd-numbered display signals in the K display signals. In addition, the S300 includes: providing, by the light valve controller 20, one of the turn-on signals to the light valve 300 whenever the data driver 40 provides one of the last (K−T) or even-numbered display signals in the K display signals.

In some embodiments, the light valve turn-off period Tg1 corresponds to a time for the data driver 40 to provide first T display signals in the image rendering period, and the light valve turn-on period Tg2 corresponds to a time for the data driver 40 to provide last (K−T) display signals in the image rendering period.

In some other embodiments, the light valve turn-off period Tg1 corresponds to a time for the data driver 40 to provide odd-numbered display signals in the image rendering period, and the light valve turn-on period Tg2 corresponds to a time for the data driver 40 to provide even-numbered display signals in the image rendering period.

In some other embodiments, before S200, the method further includes S800 and S900.

In S800, the timing controller 10 provides the first timing signal and the second timing signal to the light valve controller 20.

In S900, the light valve controller 20 generates a third timing signal according to the first timing signal and the second timing signal, the third timing signal including turn-off signals and turn-on signals.

In this case, the S200 includes: the light valve controller 20 provides one of the turn-off signals to the light valve 300 whenever the data driver 40 provides one of the first T or odd-numbered display signals in the K display signals. In addition, the S300 includes: providing, by the light valve controller 20, one of the turn-on signals to the light valve 300 whenever the data driver 40 provides one of the last (K−T) or even-numbered display signals in the K display signals.

In some embodiments, the relationship between the image refresh rate η and the image rendering rate γ is that the image refresh rate η is equal to K times the image rendering rate γ, that is, η is equal to a product of K and γ.

In this way, in each image rendering period Tx, the display panel 200 refreshes the image K times continuously and displays K frames based on same set of image data, thereby improving the display effect of the image.

In some embodiments, K is equal to 2.

Based on the above embodiments, the data driver 40 transmits the same set of image data to the display panel 200 twice in one image rendering period Tx, so that the display panel 200 continuously refreshes an image twice in each image rendering period Tx, and the two refreshed images are based on the same set of image data, that is, the display panel 200 displays two frames based on the same set of image data. The frame displayed for the first time on the display panel 200 in the image rendering period Tx is defined as an odd-numbered frame, and the image displayed for the second time on the display panel 200 in the image rendering period Tx is defined as an even-numbered frame.

In some embodiments, T is equal to 1.

When the display panel 200 enters the next image rendering period from one image rendering period, the image displayed for the first time on the display panel 200 cannot reach the requirement for the target gray scales, and the image displayed for the second time can reach the requirement for target gray scales. On this basis, T is set to be 1, so that the light valve controller 20 controls the light valve 300 to block the image displayed for the first time on the display panel 200 in each image rendering period Tx. In this way, the time, during which the image displayed on the display panel 200 is blocked by the light valve 300, in each image rendering period Tx may be shorten, the time, during which the image displayed on the display panel 200 is not blocked by the light valve 200 and can be viewed by the users, may be increased. As such, the time of the display panel going black can be reduced, and the flickering phenomenon caused by the image displayed on the display panel being blocked can be reduced, thus improving the display effect of the display panel 200.

In some examples, the image refresh rate $\eta$ is equal to 120 Hz, and the image rendering rate $\gamma$ is equal to 60 Hz.

The beneficial effects of the display control method are the same as the beneficial effects of the display control apparatus 100 provided by some embodiments of the present disclosure, which will be not repeated here.

Figure 7:
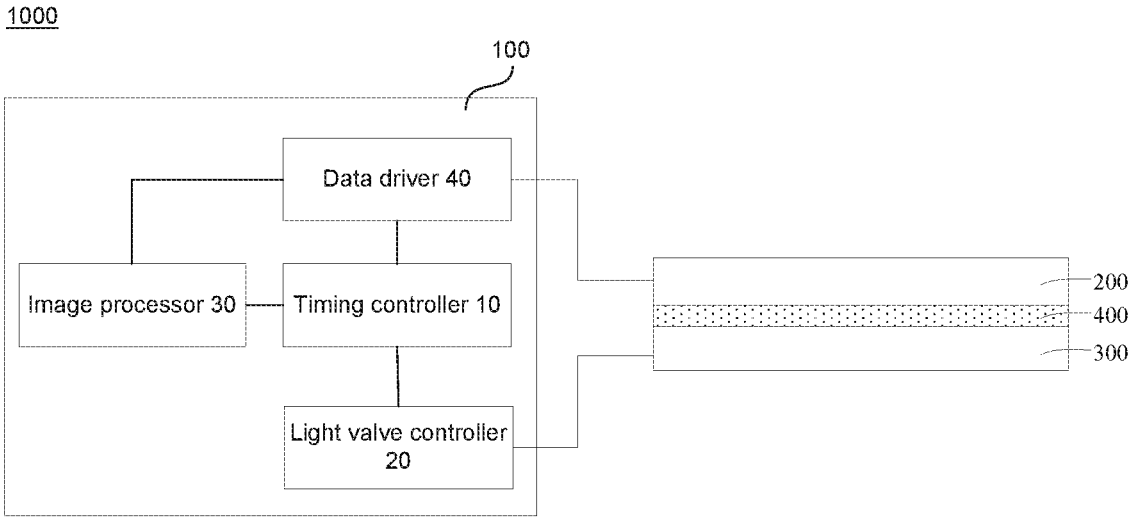
FIG. 7 is yet another block diagram of a display control apparatus, in accordance with some embodiments.

As shown in FIG. 7, in the display apparatus 1000, the light valve 300 may be disposed on the display surface of the display panel 200. For example, the light valve 300 may be fixed on the display surface of the display panel 200 by adhesive 400. The light valve 300 is configured to block the light emitted from the display surface of the display panel 200, or allow the light emitted from the display surface of the display panel 200 to pass through.

For example, the light valve 300 can be in a light-transmissive state or an opaque state. In the light-transmissive state, the light valve 300 can allow the light emitted from the display surface of the display panel 200 to pass through, so that the images displayed on the display panel 200 can be viewed by the users. In the opaque state, the light valve 300 can block the light emitted from the display surface of the display panel 200, so that the images displayed on the display panel 200 cannot be viewed by the users.

The display control apparatus 100 is coupled to the display panel 200 and the light valve 300. For example, in a case where the display control apparatus 100 includes the timing controller 10, the light valve controller 20, the image processor 30 and the data driver 40, the data driver 40 is coupled to the display panel 200 through a data interface, and the data driver 200 can control the display panel 600 according to the image data to refresh the image, so as to display the images. The light valve controller 20 is coupled to the light valve 300, and the light valve controller 20 can control the light valve 300 to block the light emitted from the display surface of the display panel 200, or allow the light emitted from the display surface of the display panel 200 to pass through.

In some embodiments, the display apparatus may be any product or component having a display function such as a mobile phone, a tablet computer, a television, a display, a notebook computer, a digital photo frame, or a navigator. In some other embodiments, the display apparatus provided by some embodiments of the present disclosure may be applied in the fields of VR and augmented reality (AR). For example, the display apparatus is a virtual reality display apparatus, or an augmented reality apparatus. For example, the display apparatus is a VR headset.

In some embodiments, the light valve 300 is a liquid crystal light valve. The liquid crystal light valve controls the refractive index of liquid crystal molecules through voltage to achieve the phase retardation of light. For example, the liquid crystal light valve includes a first substrate, a second substrate, and a liquid crystal layer disposed between the first substrate and the second substrate. The light valve controller 20 in the display control apparatus 100 outputs a turn-on or turn-off signal to control the voltage across both sides of the liquid crystal layer to control the arrangement direction of the liquid crystal molecules in the liquid crystal layer, so that the liquid crystal light valve is in the light-transmissive state or in the opaque state. In the light-transmissive state, the light valve 300 can allow the light emitted from the display surface of the display panel 200 to pass through, so that the images displayed on the display panel 200 can be viewed by the users. In the opaque state, the light valve can block the light emitted from the display surface of the display panel 200, so that the images displayed on the display panel 200 cannot be viewed by the users.

The display panel 200 may be an OLED display panel, or a micro light-emitting diode (LED) display panel, or a mini LED display panel, etc.

The beneficial effects of the display apparatus 1000 are the same as the beneficial effects of the display control apparatus 100 provided by some embodiments of the present disclosure, which will be not repeated here.

Some embodiments of the present disclosure provide a non-transitory computer-readable storage medium storing computer program instructions that, when executed by a processor (for example, the image processor), cause the processor to perform one or more steps in the display control method described in any of the foregoing embodiments.

For example, the computer-readable storage media includes but is not limited to: a magnetic storage device (e.g., a hard disk, a floppy disk, or a magnetic tape, etc.), an optical disk (e.g., a compact disk (CD), a digital versatile disk (DVD), etc.), a smart card and a flash memory device (e.g., an erasable programmable read-only memory (EPROM), a card, a stick or a key drive, etc.).

Some embodiments of the present disclosure provide a computer program product. The computer program product includes computer program instructions that, when executed by a computer (for example, the image processor), cause the computer to perform one or more steps in the display control method described in any of the foregoing embodiments.

The beneficial effects of the non-transitory computer-readable storage and the computer program product are the same as the beneficial effects of the display control apparatus 100 provided by some embodiments of the present disclosure, which will be not repeated here.

The forgoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A display control apparatus, comprising a timing controller, an image processor, a data driver and a light valve controller, wherein the timing controller is electrically connected to the image processor and the data driver, and configured to generate a first timing signal according to an image rendering rate, and to generate a second timing signal according to an image refresh rate; and to provide the first timing signal and the second timing signal to the image processor and the data driver respectively;

the image processor is electrically connected to the data driver and configured to provide a plurality of sets of image data to the data driver at the image rendering rate in response to a first timing signal;

the data driver is configured to continuously provide K display signals, every K display signals of which include a same set of image data, to a display panel at the image refresh rate in response to the second timing signal, wherein K is an integer greater than or equal to 2; and the light valve controller is configured to provide a turn-off signal to a light valve whenever the data driver provides one of first T or odd-numbered display signals in the K display signals, and provide a turn-on signal to the light valve whenever the data driver provides one of last (K−T) or even-numbered display signals in the K display signals, wherein T is an integer greater than 0 and less than K, and (K−T) refers to a difference between K and T.

2. The display control apparatus according to claim 1, wherein the timing controller is further electrically connected to the light valve controller, and is further configured to generate a third timing signal according to the image rendering rate and the image refresh rate, and provide the third timing signal to the light valve controller, the third timing signal including turn-off signals and turn-on signals; and the light valve controller is configured to:

provide one of the turn-off signals to the light valve whenever the data driver provides one of the first T or odd-numbered display signals in the K display signals; and provide one of the turn-on signals to the light valve whenever the data driver provides one of the last (K−T) or even-numbered display signals in the K display signals.

3. The display control apparatus according to claim 1, wherein the timing controller is further electrically connected to the light valve controller, and is further configured to provide the first timing signal and the second timing signal to the light valve controller, and the light valve controller is configured to:

generate a third timing signal according to the first timing signal and the second timing signal, the third timing signal including turn-off signals and turn-on signals;

provide one of the turn-off signals to the light valve whenever the data driver provides one of the first T or odd-numbered display signals in the K display signals; and provide one of the turn-on signals to the light valve whenever the data driver provides one of the last (K−T) or even-numbered display signals in the K display signals.

4. The display control apparatus according to claim 1, wherein the image refresh rate is equal to 120 Hz and the image rendering rate is equal to 60 Hz.

5. The display control apparatus according to claim 1, wherein the timing controller includes the light valve controller, and is electrically connected to the light valve; and the timing controller is further configured to:

generate a third timing signal according to the image rendering rate and the image refresh rate, the third timing signal including turn-off signals and turn-on signals; and provide the third timing signal to the light valve controller.

6. The display control apparatus according to claim 1, wherein T is equal to 1.

7. The display control apparatus according to claim 1, wherein K is equal to 2.

8. A display control method, comprising:

providing continuously, by a data driver, K display signals, all of which include a same set of image data, to a display panel, so that the display panel continuously refreshes an image K times based on the same set of image data, wherein K is an integer greater than or equal to 2;

providing, by a light valve controller, a turn-off signal to a light valve whenever the data driver provides one of first T or odd-numbered display signals in the K display signals, so that the light valve blocks images displayed in first T or odd-numbered times on the display panel, wherein T is an integer greater than 0 and less than K; and providing, by the light valve controller, a turn-on signal to the light valve whenever the data driver provides one of last (K−T) or even-numbered display signals in the K display signals, wherein (K−T) refers to a difference between K and T, and wherein before providing continuously, by the data driver, K display signals, all of which include a same set of image data, to the display panel, the method further comprises:

generating, by a timing controller, a first timing signal according to an image rendering rate;

generating, by the timing controller, a second timing signal according to an image refresh rate;

providing, by the timing controller, the first timing signal to an image processor;

providing, by the timing controller, the second timing signal to the data driver; and providing, by the image processor, a plurality of sets of image data to the data driver at the image rendering rate in response to the first timing signal, and wherein providing continuously, by the data driver, K display signals, all of which include a same set of image data, to the display panel, includes:

providing, by the data driver, display signals, every K display signals of which include a same set of image data, to the display panel at the image refresh rate in response to the second timing signal.

9. The display control method according to claim 8, wherein before providing, by the light valve controller, a turn-off signal to the light valve whenever the data driver provides one of first T or odd-numbered display signals in the K display signals, the method further comprises:

generating, by the timing controller, a third timing signal according to the image rendering rate and the image refresh rate, the third timing signal including turn-off signals and turn-on signals; and providing, by the timing controller, the third timing signal to the light valve controller, and wherein providing, by the light valve controller, a turn-off signal to the light valve whenever the data driver provides one of first T or odd-numbered display signals in the K display signals includes:

providing, by the light valve controller, one of the turn-off signals to the light valve whenever the data driver provides one of first T or odd-numbered display signals in the K display signals, and wherein providing, by the light valve controller, a turn-on signal to the light valve whenever the data driver provides one of last (K−T) or even-numbered display signals in the K display signals, includes:

providing, by the light valve controller, one of the turn-on signals to the light valve whenever the data driver provides one of last (K−T) or even-numbered display signals in the K display signals.

10. The display control method according to claim 8, wherein before providing, by the light valve controller, a turn-off signal to the light valve whenever the data driver provides one of first T or odd-numbered display signals in the K display signals, the method further comprises:

providing, by the timing controller, the first timing signal and the second timing signal to the light valve controller, generating, by the light valve controller, a third timing signal according to the first timing signal and the second timing signal, the third timing signal including turn-off signals and turn-on signals;

and wherein providing, by the light valve controller, a turn-off signal to the light valve whenever the data driver provides one of first T or odd-numbered display signals in the K display signals, includes:

providing, by the light valve controller, one of the turn-off signals to the light valve whenever the data driver provides one of first T or odd-numbered display signals in the K display signals, and wherein providing, by the light valve controller, a turn-on signal to the light valve whenever the data driver provides one of last (K−T) or even-numbered display signals in the K display signals, includes:

providing, by the light valve controller, one of the turn-on signals to the light valve whenever the data driver provides one of last (K−T) or even-numbered display signals in the K display signals.

11. The display control method according to claim 8, wherein the image refresh rate is equal to 120 Hz and the image rendering rate is equal to 60 Hz.

12. The display control method according to claim 8, wherein T is equal to 1.

13. The display control method according to claim 8, wherein K is equal to 2.

14. A display apparatus, comprising:

a display panel;

a light valve disposed on a display surface of the display panel, the light valve being configured to block light emitted from the display surface of the display panel, or allow the light emitted from the display surface of the display panel to pass through; and the display control apparatus according to claim 1, the display control apparatus being coupled to the display panel and the light valve.

15. The display apparatus according to claim 14, wherein the light valve is a liquid crystal light valve.

16. A non-transitory computer-readable storage medium storing computer program instructions that, when executed by a processor, cause the processor to perform one or more steps of the display control method according to claim 8.

* * * * *